US010625272B2

(12) United States Patent
Yang et al.

(10) Patent No.: US 10,625,272 B2
(45) Date of Patent: Apr. 21, 2020

(54) MAGNETIC SEPARATOR

(71) Applicant: Industrial Technology Research Institute, Hsinchu (TW)

(72) Inventors: Ming-Da Yang, Taichung (TW); Mean-Jue Tung, Jincheng Township (TW); Yu-Ting Huang, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 120 days.

(21) Appl. No.: 15/355,638

(22) Filed: Nov. 18, 2016

(65) Prior Publication Data

US 2017/0165678 A1 Jun. 15, 2017

Related U.S. Application Data

(60) Provisional application No. 62/256,706, filed on Nov. 18, 2015.

(51) Int. Cl.
*B03C 1/033* (2006.01)
*H01F 7/02* (2006.01)
(Continued)

(52) U.S. Cl.
CPC ..... *B03C 1/033* (2013.01); *B03C 1/01* (2013.01); *B03C 1/034* (2013.01); *H01F 7/0205* (2013.01);
(Continued)

(58) Field of Classification Search
CPC ..... B03C 1/01; B03C 1/033; B03C 1/034; B03C 1/0332; B03C 2201/18; B03C 2201/26; H01F 7/0205; H01F 7/0273
(Continued)

(56) References Cited

U.S. PATENT DOCUMENTS 2,331,769 A * 10/1943 Frantz ..... B03C 1/034 209/224
4,289,621 A * 9/1981 O'Meara, Jr. ..... B03C 1/28 210/222
(Continued)

FOREIGN PATENT DOCUMENTS

CN 2429832 Y 5/2001
CN 2609931 Y 4/2004
(Continued)

OTHER PUBLICATIONS

Chen et al., "2D modeling and preliminary in vitro investigation of a prototype high gradient magnetic separator for biomedical applications," Medical Engineering & Physics, vol. 30, 2008, pp. 1-8.
(Continued)

*Primary Examiner* — David C Mellon
(74) *Attorney, Agent, or Firm* — Birch, Stewart, Kolasch & Birch, LLP

(57) ABSTRACT

A magnetic separator including a magnetic structure is provided. The magnetic structure includes magnetic structure units. The magnetic structure units form at least one continuous fluid channel. Each of the magnetic structure units has at least one protrusion. The magnetic structure has the protrusions facing towards each other between at least a portion of the adjacent two magnetic structure units.

17 Claims, 13 Drawing Sheets

(51) Int. Cl.
*B03C 1/01* (2006.01)
*B03C 1/034* (2006.01)

(52) U.S. Cl.
CPC ..... *B03C 2201/18* (2013.01); *B03C 2201/26* (2013.01)

(58) Field of Classification Search
USPC ..... 210/222, 223, 695
See application file for complete search history.

(56) References Cited

U.S. PATENT DOCUMENTS

| | | | | |
|---|---|---|---|---|
| 5,169,006 | A | 12/1992 | Stelzer | |
| 5,411,863 | A | 5/1995 | Miltenyi | |
| 5,705,059 | A | 1/1998 | Miltenyi | |
| 5,711,871 | A | 1/1998 | Miltenyi | |
| 5,868,939 | A | 2/1999 | Oder et al. | |
| 5,985,153 | A * | 11/1999 | Dolan | B01L 3/502 209/214 |
| 6,241,894 | B1 | 6/2001 | Briggs et al. | |
| 9,884,326 | B2 * | 2/2018 | Oki | B03C 1/032 |
| 2004/0018611 | A1 | 1/2004 | Ward et al. | |
| 2005/0035030 | A1 | 2/2005 | Oder et al. | |
| 2009/0311733 | A1 * | 12/2009 | Korpela | B03C 1/01 435/29 |
| 2012/0024770 | A1 * | 2/2012 | Ying | B03C 1/002 210/222 |
| 2014/0227777 | A1 | 8/2014 | Choi et al. | |

FOREIGN PATENT DOCUMENTS

| | | | |
|---|---|---|---|
| CN | 101085874 | A | 12/2007 |
| EP | 0941766 | A2 | 9/1999 |
| TW | 200506365 | | 2/2005 |
| WO | WO 99/19071 | A1 | 4/1999 |

OTHER PUBLICATIONS

Kato et al., "Isolation and Characterization of CD34+ Hematopoietic Stem Cells From Human Peripheral Blood by High-Gradient Magnetic Cell Sorting," Cytometry, vol. 14, 1993, pp. 384-392.
Mazutis et al., "Single-cell analysis and sorting using droplet-based microfluidics," Nature Protocols, vol. 8, No. 5, May 2013, pp. 870-891 (48 pages total).
Miltenyi et al., "High Gradient Magnetic Cell Separation With MACS," Cytometry, vol. 11, 1990, pp. 231-238.
Oberteuffer, "High Gradient Magnetic Separation," IEEE Transactions on Magnetics, vol. MAG-9, No. 3, Sep. 1973 (presented at the Intermag Conference, Apr. 24-27, 1973), pp. 303-306.
Watson, "Magnetic filtration," Journal of Applied Physics, vol. 44, No. 9, Sep. 1973, pp. 4209-4213 (6 pages total).
Wu et al., "Pulsed laser triggered high speed microfluidic fluorescence activated cell sorter," Lab Chip, vol. 12, Feb. 15, 2012, pp. 1378-1383.
Taiwanese Office Action and Search Report, dated Jun. 6, 2017, for Taiwanese Application No. 105137765.

* cited by examiner

MAGNETIC SEPARATOR

CROSS-REFERENCE TO RELATED APPLICATION

This application claims the priority benefits of U.S. provisional application Ser. No. 62/256,706, filed on Nov. 18, 2015. The entirety of the above-mentioned patent application is hereby incorporated by reference herein and made a part of this specification.

BACKGROUND

Technical Field

The disclosure relates to a separator, and more particularly, to a magnetic separator.

Background

A magnetic separator is a device that performs a magnetic field treatment on magnetic substances with magnetic separation technology, it is mainly an emerging technology using a difference between magnetic susceptibilities of elements or components, and with the use of external magnetic field, to perform the magnetic field treatment on the magnetic substances to achieve separation. Moreover, the application scope of the magnetic separator has been extended to various fields.

In order to more effectively separate the magnetic substances with the magnetic separator, current industry is actively studying on how to enhance the separation effect of the magnetic separator.

SUMMARY

The disclosure provides a magnetic separator including a magnetic structure. The magnetic structure includes magnetic structure units. The magnetic structure units form at least one continuous fluid channel. Each of the magnetic structure units has at least one protrusion and at least a portion of the adjacent two magnetic structure units has the protrusions facing towards each other. The magnetic structure may be a palisade magnetic structure.

Several exemplary embodiments accompanied with figures are described in detail below for easy to understand the features and advantages of the disclosure.

DETAILED DESCRIPTION OF DISCLOSED EMBODIMENTS

Figure 1:
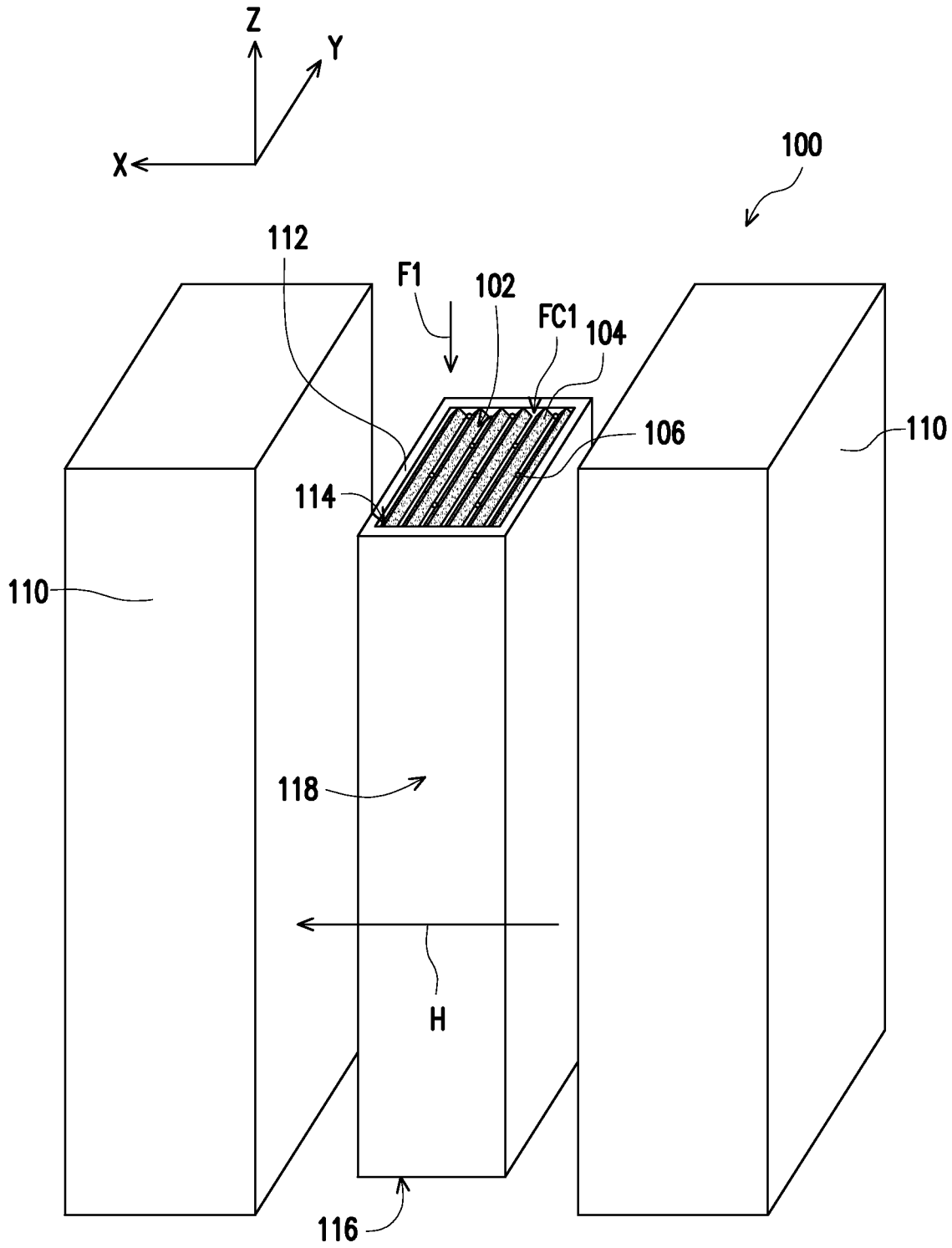
FIG. 1 is a schematic view illustrating of a magnetic separator according to an embodiment of the disclosure.
Figure 2:
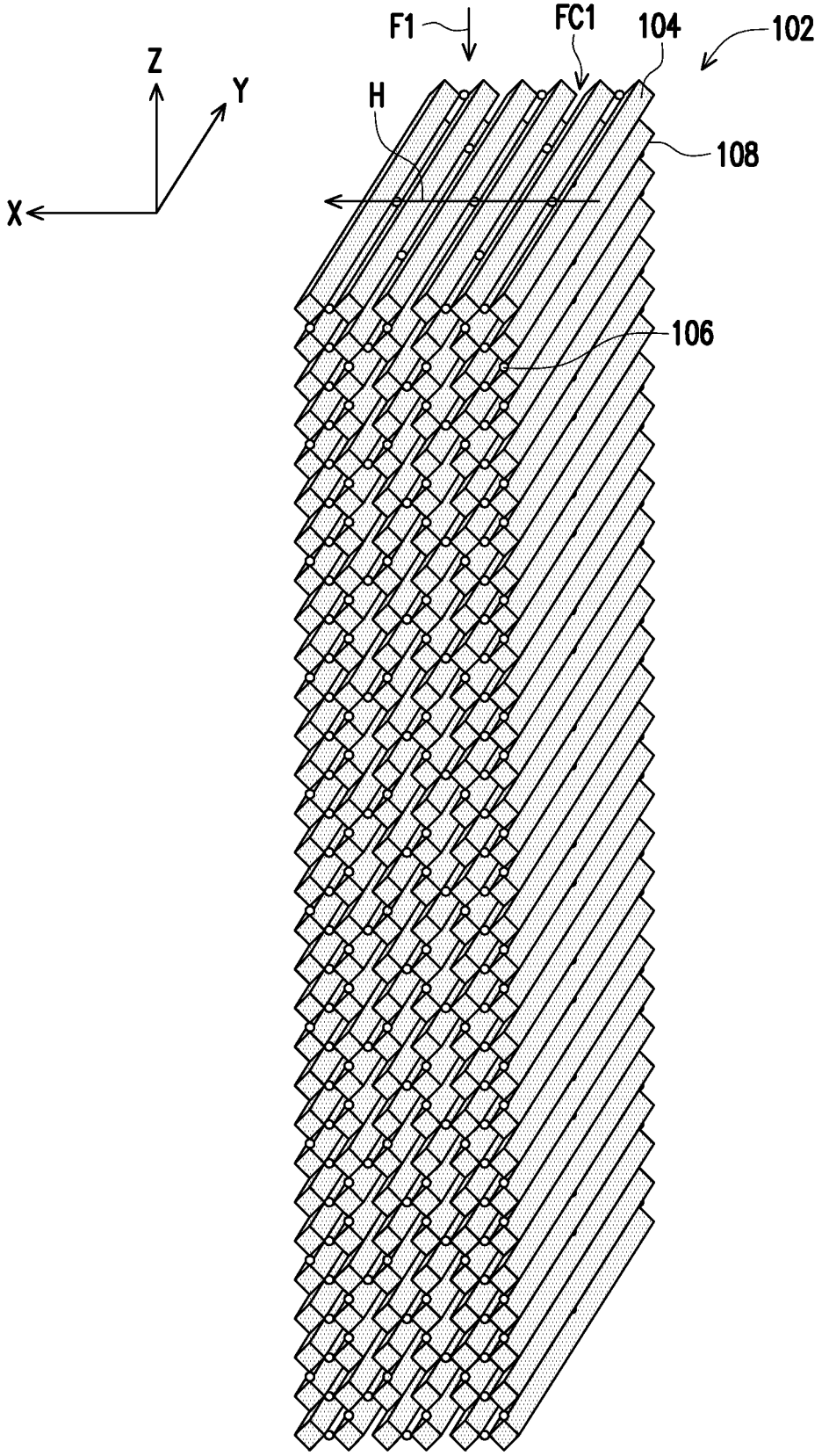
FIG. 2 is a schematic view illustrating a palisade magnetic structure of FIG. 1.
Figure 3:
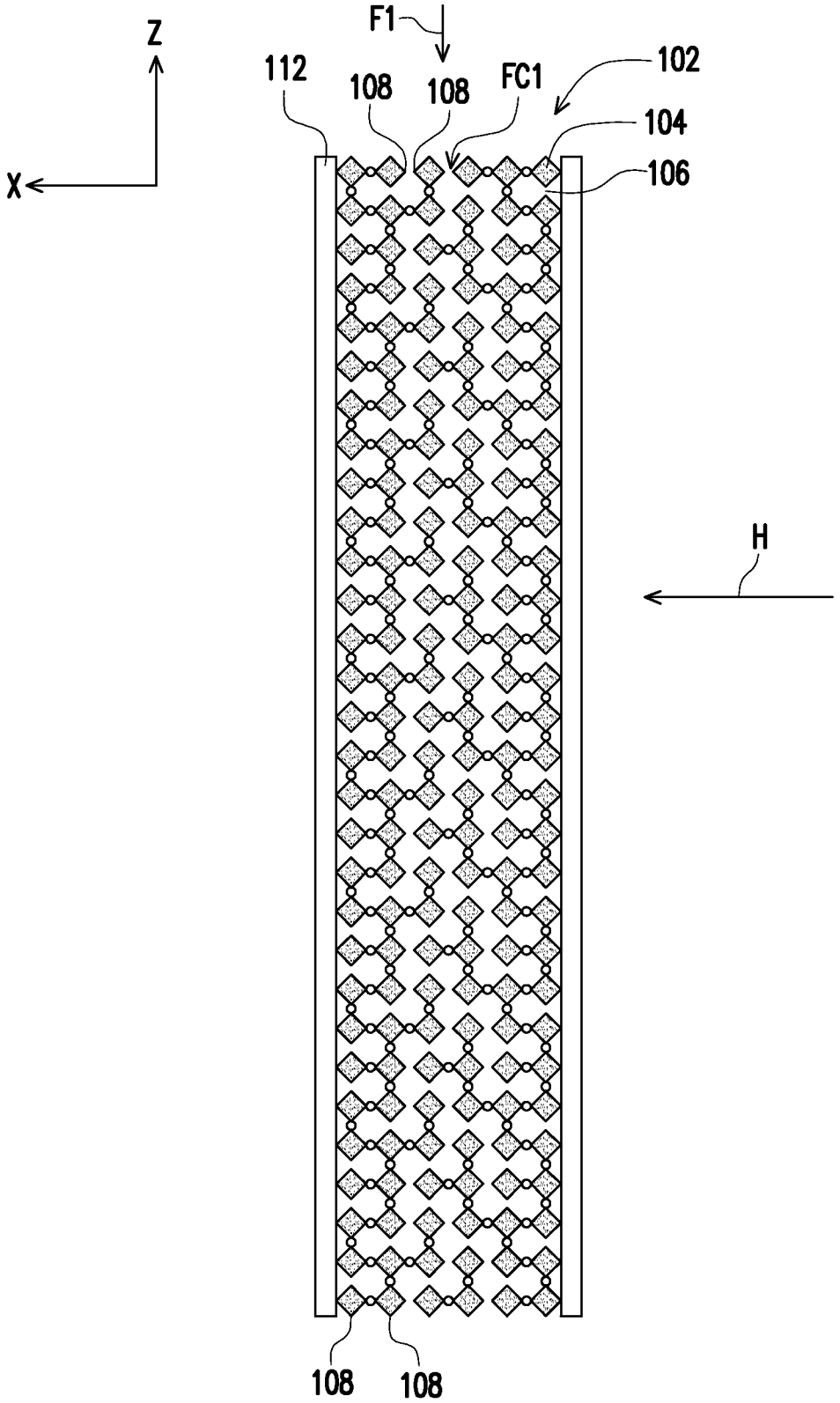
FIG. 3 is a perspective side view illustrating the palisade magnetic structure of FIG. 1 in an axial direction.
Figure 4:
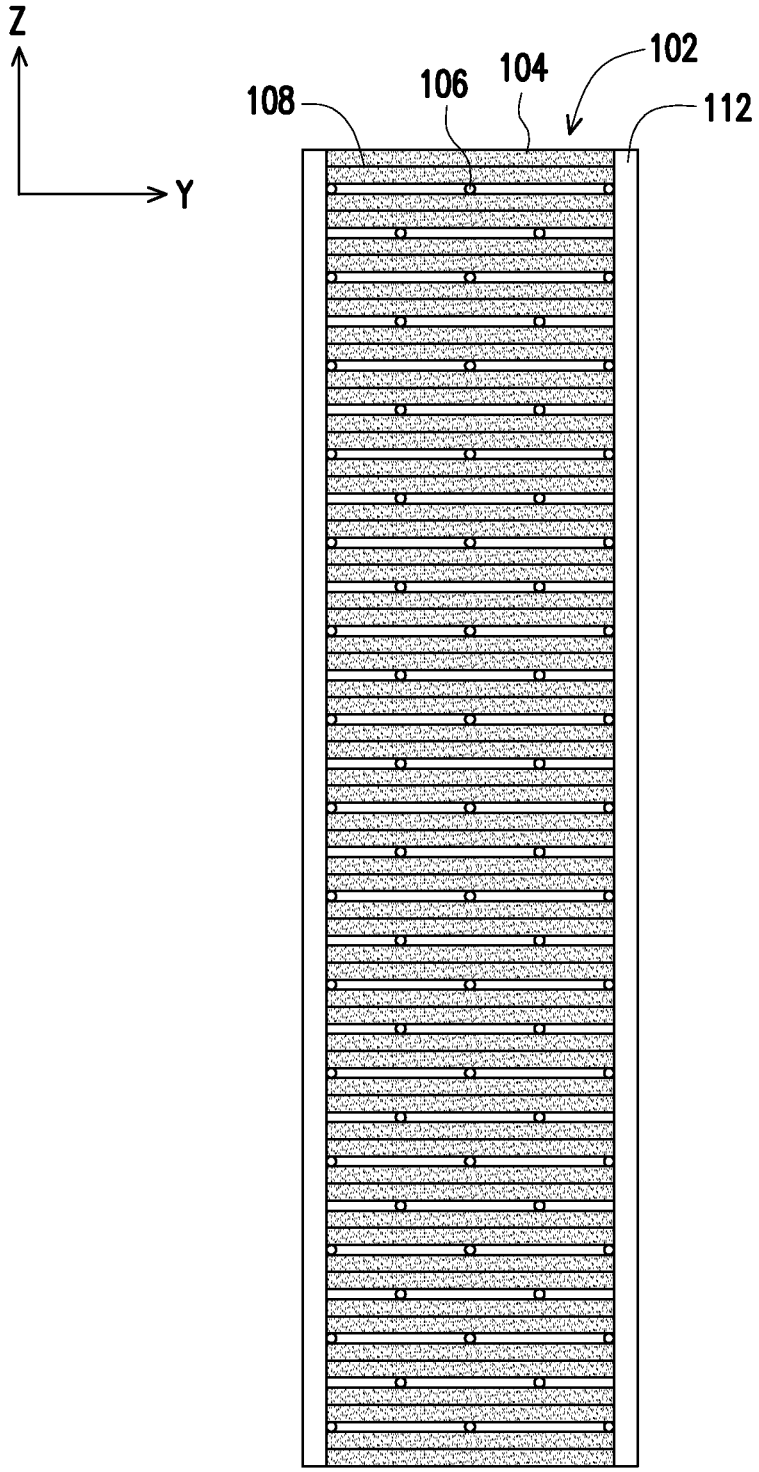
FIG. 4 is a perspective side view illustrating the palisade magnetic structure of FIG. 1 in an arrangement direction.
Figure 5:
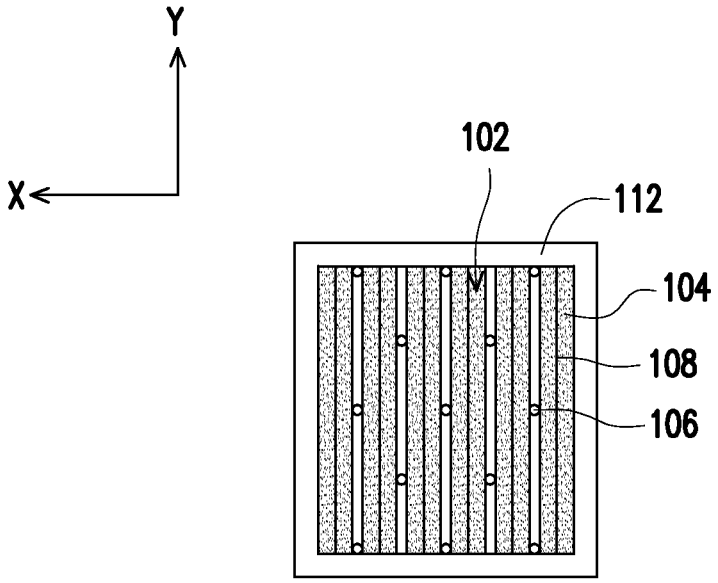
FIG. 5 is a top view illustrating the palisade magnetic structure of FIG. 1 in a stacking direction.
Figure 6:
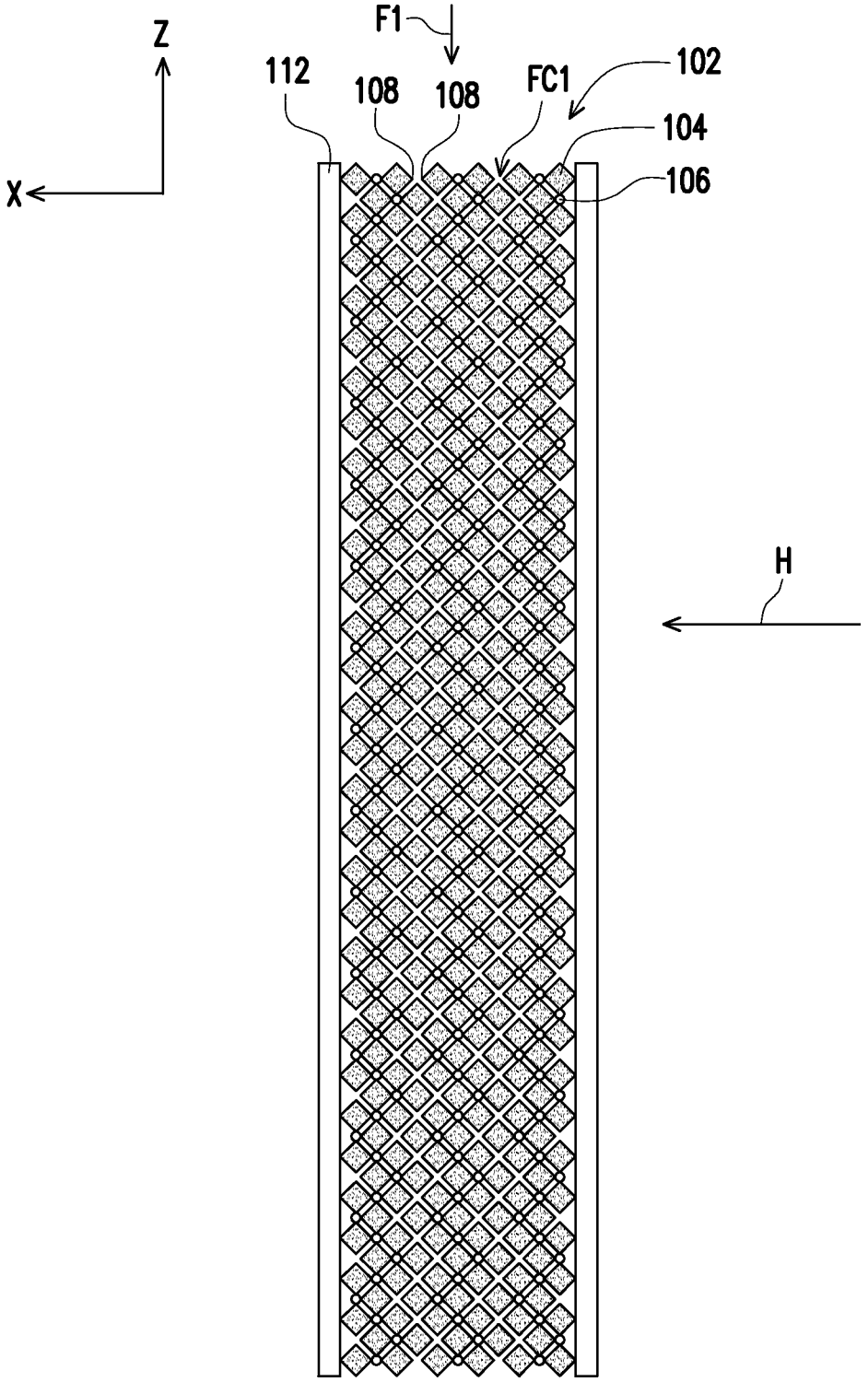
FIG. 6 is a perspective side view illustrating a palisade magnetic structure in an axial direction according to another embodiment of the disclosure.
Figure 7A:
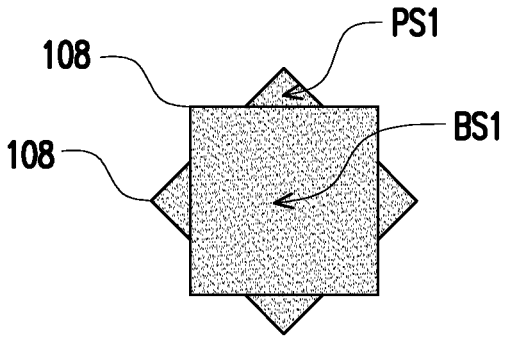
FIG. 7A and FIG. 7B are schematic cross-sectional views illustrating magnetic structure units in an arrangement direction according to other embodiment of the disclosure.
Figure 7B:
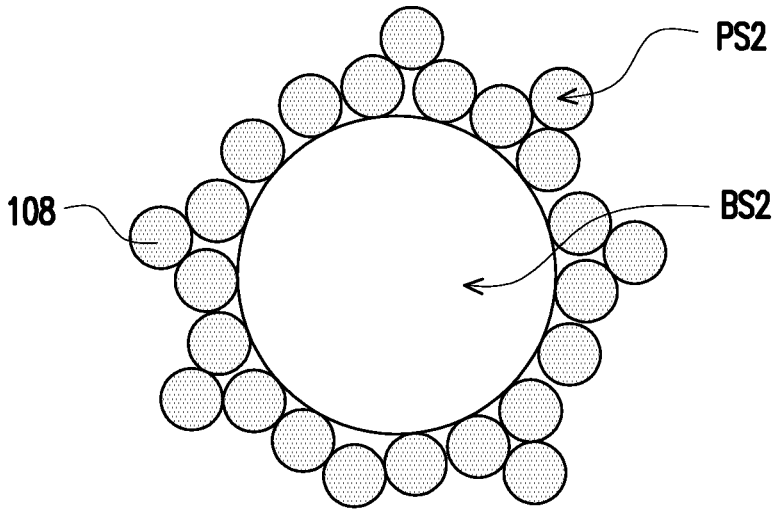

FIG. 1 is a schematic view illustrating of a magnetic separator according to an embodiment of the disclosure. FIG. 2 is a schematic view illustrating a palisade magnetic structure of FIG. 1. FIG. 3 is a perspective side view illustrating the palisade magnetic structure of FIG. 1 in an axial direction. FIG. 4 is a perspective side view illustrating the palisade magnetic structure of FIG. 1 in an arrangement direction. FIG. 5 is a top view illustrating the palisade magnetic structure of FIG. 1 in a stacking direction. FIG. 6 is a perspective side view illustrating a palisade magnetic structure in an axial direction according to another embodiment of the disclosure. FIG. 7A and FIG. 7B are schematic cross-sectional views illustrating magnetic structure units in an arrangement direction according to other embodiment of the disclosure.

Referring to FIG. 1 through FIG. 5 at the same time, a magnetic separator 100 includes a magnetic structure, such as a palisade magnetic structure 102, but the magnetic structure of the disclosure is not limited to the palisade shape. The magnetic separator 100 can be used to separate magnetic substances, and thus can be a separator for biochemical substance separation treatment, iron removal treatment, mineral sorting treatment, or industrial water treatment. For example, when performing the biochemical substance separation treatment, biochemical substances are bonded onto the magnetic substances, and then a sample solution is enabled to pass through the palisade magnetic structure 102 along a flowing direction F1 so that the magnetic substances in the sample solution are absorbed by a magnetic field and thus are separated from the biochemical substances. The biochemical substances are, for example, cells (e.g., stem cells), microorganisms, proteins, amino acids, or nucleotides.

The palisade magnetic structure 102 includes magnetic structure units 104. The magnetic structure units 104 are, for example, columnar magnetic structure units or magnetic bead structure units. In the present embodiment, the magnetic structure units 104 are exemplified by the columnar magnetic structure units, and the magnetic structure units 104 can extend along an axial direction Y. In other embodiments, the magnetic structure units 104 may also be the magnetic bead structure units.

The magnetic structure units 104 can be arranged into the palisade shape along an arrangement direction X. Moreover, the magnetic structure units 104 that are arranged into the palisade shape can further be stacked along a stacking direction Z. A length of the palisade magnetic structure 102 in the stacking direction Z can be greater than or equal to a length of the palisade magnetic structure 102 in the arrangement direction X, and thus can further enhance the separation effect.

In addition, the palisade magnetic structure 102 may further include at least one connecting member 106. The connecting member 106 is connected between two of the magnetic structure units 104, such as between the adjacent two magnetic structure units 104, and can be used to fix the positions of the magnetic structure units 104 to secure the structure of the palisade magnetic structure 102. The connecting member 106 can connect the magnetic structure units 104 with each other in the arrangement direction X, thereby forming base palisade units of the magnetic structure units 104. The connecting member 106 can further connect the base palisade units in the stacking direction Z so as to form a stacked palisade structure. The connecting member 106 and the magnetic structure units 104 may be an integrally formed component or independently formed components. The connecting members 106 may be disposed in a manner of regular arrangement or irregular arrangement. The arrangement of the connecting members 106 as shown in FIG. 1 through FIG. 6 is merely provided for illustrative purposes, and the disclosure is not limited thereto. In another embodiment, the palisade magnetic structure 102 may not include the connecting members 106, instead, the magnetic structure units 104 are directly stacked to form the palisade magnetic structure 102.

Referring to FIG. 3 and FIG. 6 at the same time, the magnetic structure units 104 may be periodically arranged or non-periodically arranged. In the present embodiment, the magnetic structure units 104 are exemplified by being periodically arranged (e.g., as shown in FIG. 3), but the disclosure is not limited thereto. In another embodiment, the magnetic structure units 104 may also be non-periodically arranged (e.g., as shown in FIG. 6).

Referring to FIG. 3, a cross-sectional shape of each of the magnetic structure units 104 along the arrangement direction X can be a polygon. In the present embodiment, the cross-sectional shape of the magnetic structure units 104 along the arrangement direction X is exemplified by using a square. In other embodiments, the cross-sectional shape of the magnetic structure units 104 along the arrangement direction X may also be rhombic, triangular, hexagonal, octagonal or so forth. Moreover, when the long axis of the cross-sectional shape of the magnetic structure units 104 is parallel to the arrangement direction X (e.g., rhombus), it is conducive for enhancing the magnetic field gradient.

In addition, referring to FIG. 7A and FIG. 7B, the cross-sectional shape of the magnetic structure units 104 in the arrangement direction X can also be a shape constituted by a base shape BS of the magnetic structure unit 104 and a protruding shape PS of the at least one protrusion. For example, in FIG. 7A and FIG. 7B, a base shape BS1 and a base shape BS2 are respectively a square (FIG. 7A) and a circle (FIG. 7B), and a protruding shape PS1 and a protruding shape PS2 are respectively a triangle (FIG. 7A) and a circle (FIG. 7B), but the scope of the disclosure is not limited thereto. In other embodiments, the base shape BS1 and the base shape BS2 may also be rhombus, triangles, hexagons, octagons or so forth. The protruding shape PS1 and the protruding shape PS2 may also be rectangles, irregular shapes or a combination thereof.

Referring to FIG. 1 and FIG. 3, the magnetic structure units 104 form at least one continuous fluid channel FC1. The continuous fluid channel FC1 can extend along the stacking direction Z. In addition, the flowing direction F1 of the sample solution in the continuous fluid channel FC1 is, for example, parallel to the stacking direction Z.

Referring to FIG. 2 through FIG. 3, each of the magnetic structure units 104 has at least one protrusion 108. The palisade magnetic structure 102 has the protrusions 108 facing towards each other between at least a portion of the adjacent two magnetic structure units 104 so as to effectively enhance the magnetic field gradient, thereby enabling the magnetic separator 100 to show the better separation effect. Between the adjacent two magnetic structure units 104, an extension line formed by connecting the protrusions 108 facing towards each other can be parallel to a magnetic field direction H, thereby further enhancing the magnetic field gradient. In the cross-sectional shape of the magnetic structure units 104 along the arrangement direction X, a cross-sectional shape of the protrusions 108 is, for example, corresponded to the corner of the polygon (FIG. 3), the protruding shape PS of the at least one protrusion protruding out of the base shape BS (FIG. 7B) or a combination thereof (FIG. 7A).

A material of the magnetic structure units 104 is, for example, a magnetic material or a composition of the magnetic material and a polymer material. The magnetic material is, for example, a metal soft magnet, a soft magnetic ferrite or a combination thereof. A material of the metal soft magnet includes iron, silicon steel, nickel iron, cobalt iron, or stainless steel. The polymer material is, for example, polylactic acid (PLA), poly(lactic-co-glycolic acid) (PLGA), polyethylene glycol (PEG), or a combination thereof. The polymer material can provide hydrophilicity and hydrophobicity, and is conducive for enhancing biocompatibility during separation of biochemical substance. A forming method of the palisade magnetic structure 102 is, for example, three-dimensional printing or injection molding. For example, the fabricated magnetic material and polymer material can be mixed first, and then be formed into gum-like strips by hot extrusion molding, thereafter the palisade magnetic structure 102 formed by the magnetic structure units 104 can be provided by the method of three-dimensional printing.

Referring to FIG. 1, the magnetic separator 100 further includes a magnetic field supply device 110. The palisade magnetic structure 102 is located inside the magnetic field supply device 110. A magnetic field direction H provided by the magnetic field supply device 110 is, for example, parallel to the arrangement direction X. The magnetic field supply device 110 is, for example, a permanent magnet or an electromagnet.

Moreover, the magnetic separator 100 further includes a housing 112. The housing 112 has an input opening 114, an output opening 116 and a separation chamber 118. The separation chamber 118 is located between the input opening 114 and the output opening 116. The magnetic structure (e.g., the palisade magnetic structure 102) is disposed inside the separation chamber 118. The material of the housing 112 is, for example, a non-magnetic material. The non-magnetic material is, for example, a polymer material, non-magnetic metal or ceramics. The polymer material is, for example, polymethyl methacrylate, acrylic, polypropylene, polyethylene, polyvinyl chloride, Teflon, plastic, or Bakelite.

According to the above embodiment, it can be known that, in the magnetic separator 100, the palisade magnetic structure 102 has the protrusions 108 facing towards each other between at least a portion of the adjacent two magnetic structure units 104. As a result, during the separating process of the magnetic substances by the magnetic separator 100, since the protrusions 108 facing towards each other can effectively enhance the magnetic field gradient, the magnetic separator 100 is able to show the better separation effect.

Figure 8A:
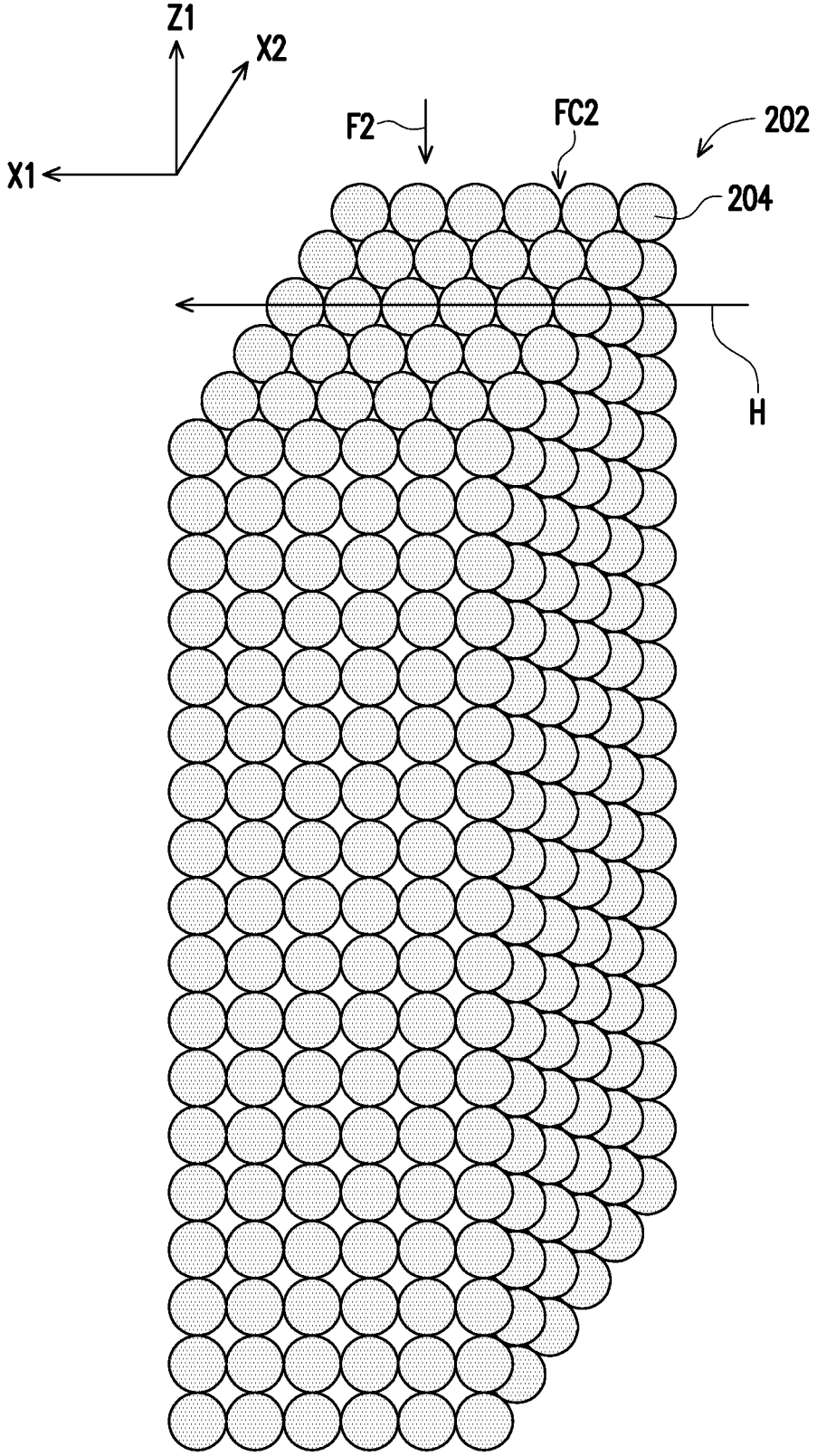
FIG. 8A is a schematic view illustrating a palisade magnetic structure according to another embodiment of the disclosure.
Figure 8B:
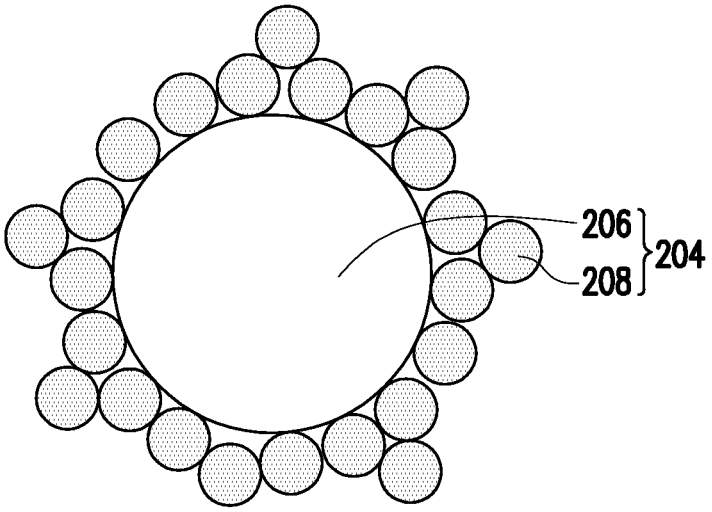
FIG. 8B is a schematic cross-sectional view illustrating the magnetic structure units of FIG. 8A.

FIG. 8A is a schematic view illustrating a palisade magnetic structure according to another embodiment of the disclosure. FIG. 8B is a schematic cross-sectional view illustrating the magnetic structure units of FIG. 8A. In order to clearly show the implementation of the magnetic structure units 204 of the present embodiment, the illustration of the magnetic structure units 204 in FIG. 8A is simplified, whereas the structure of the magnetic structure units 204 is specifically illustrated in FIG. 8B.

Referring to FIG. 8A and FIG. 8B at the same time, the palisade magnetic structure 202 includes magnetic structure units 204, and the magnetic structure units 204 are magnetic bead structure units. The magnetic structure units 204 include magnetic beads 206 and at least one protrusion 208. The magnetic beads 206 are, for example, iron beads. The protrusions 208 are, for example, metal particles, such as iron particles or so forth. A diameter of the iron particles can be from 5 nm to 10 μm. A forming method of the magnetic structure units 204 is, for example, to absorb the protrusions 208 at surfaces of the magnetic beads 206 via magnetic field alignment, and then use the polymer material, such as polylactic acid (PLA), poly(lactic-co-glycolic acid) (PLGA) or so forth, to coat on the magnetic structure units 204. The polymer material can provide hydrophilicity and hydrophobicity, and is conducive for enhancing the biocompatibility during separation of the biochemical substance.

The magnetic structure units 204 can be arranged into a palisade shape along an arrangement direction X1 and an arrangement direction X2. Moreover, the magnetic structure units 204 being arranged into the palisade shape can further be stacked along a stacking direction Z1. A length of the palisade magnetic structure 202 in the arrangement direction X2 may be greater than or equal to a length of the palisade magnetic structure 202 in the arrangement direction X1. A length of the palisade magnetic structure 202 in the stacking direction Z1 may be greater than or equal to a length of the palisade magnetic structure 202 in the arrangement direction X2, and thus can further enhance the separation effect. In the present embodiment, the palisade magnetic structure 202 can be formed by closely aligned in the housing 112 of FIG. 1, and thus can be connected without using the connecting member. In other embodiments, the connecting member may also be used to connect two magnetic structure units 204.

The palisade magnetic structure 102 in FIG. 1 can be replaced by palisade magnetic structure 202. Under a condition that the palisade magnetic structure 202 is disposed inside the housing 112, the arrangement direction X1 can be parallel to the magnetic field direction H. A continuous fluid channel FC2 can extend along the stacking direction Z1. In addition, a flowing direction F2 of the sample solution in the continuous fluid channel FC2 is, for example, parallel to the stacking direction Z1.

According to the above embodiment, it can be known that the palisade magnetic structure 202 has the protrusions 208 facing towards each other between at least a portion of the adjacent two magnetic structure units 204. As a result, during the separating process of the magnetic substances, since the protrusions 208 facing towards each other can effectively enhance the magnetic field gradient, a better separation effect can be achieved.

Figure 9A:
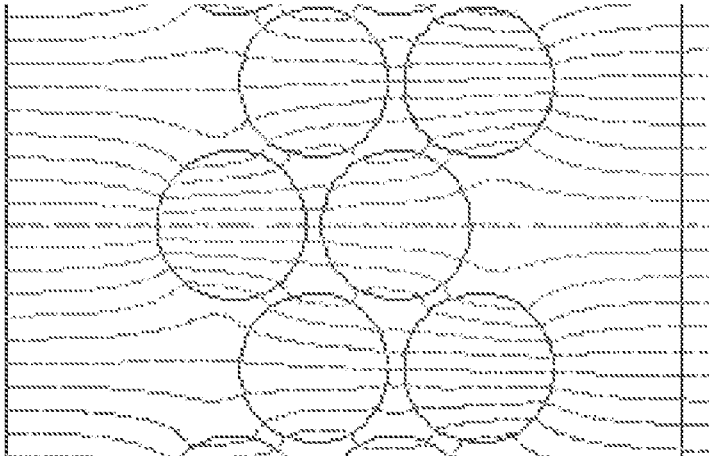
FIG. 9A and FIG. 9B are simulated diagrams of magnetic field lines of different implementations of the palisade magnetic structure.
Figure 9B:
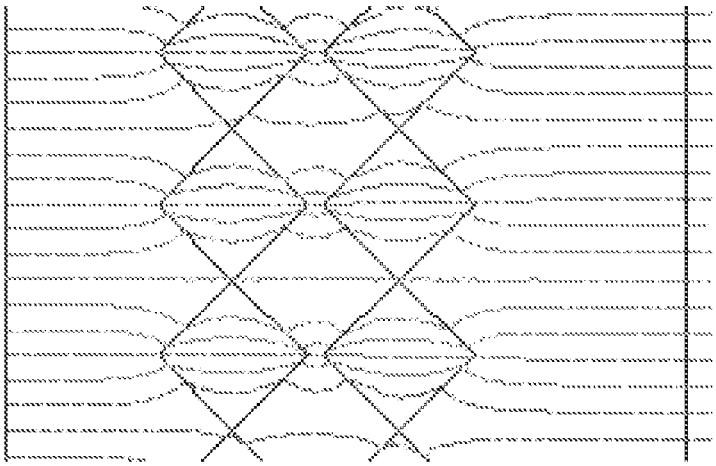

FIG. 9A and FIG. 9B are simulated diagrams of magnetic field lines of different implementations of the palisade magnetic structure.

Referring to FIG. 9A and FIG. 9B, a cross-sectional shape of the magnetic structure units in the palisade magnetic structure of FIG. 9A in the arrangement direction is a circle, in which the diameter of the circle of the magnetic structure units is 2 mm, and the magnetic permeability (μ) of the palisade magnetic structure is 1000. A cross-sectional shape of the magnetic structure units in the palisade magnetic structure of FIG. 9B in the arrangement direction is a rectangle, in which the diagonal length of the rectangle is 2 mm, and the magnetic permeability (μ) of the palisade magnetic structure of is 1000. According to FIG. 9A and FIG. 9B, it can be known that if the corners of the rectangles in FIG. 9B can be considered as the protrusions of the magnetic structure units, then the palisade magnetic structure (FIG. 9B) formed by the magnetic structure units having the protrusions can have a stronger magnetic field gradient, particularly, at between the two protrusions facing towards each other.

Figure 10A:
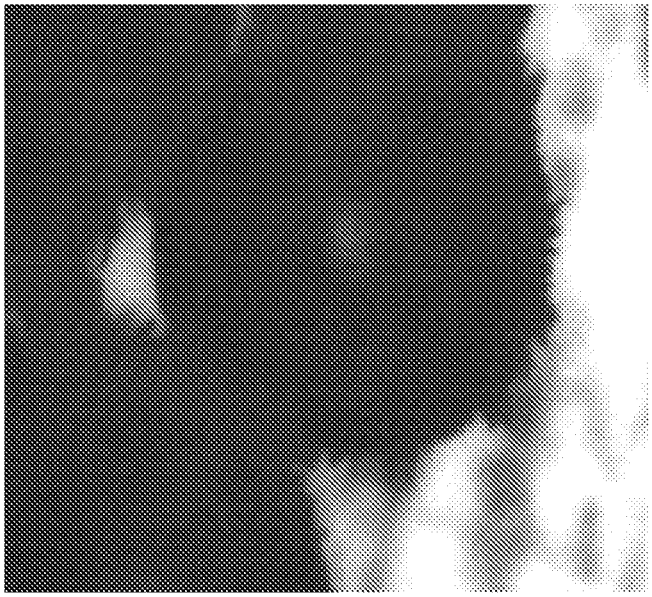
FIG. 10A is a photographic image of a magnetic structure unit captured by a microphotography system at 100× magnification according to an experimental example 1 of the disclosure.
Figure 10B:
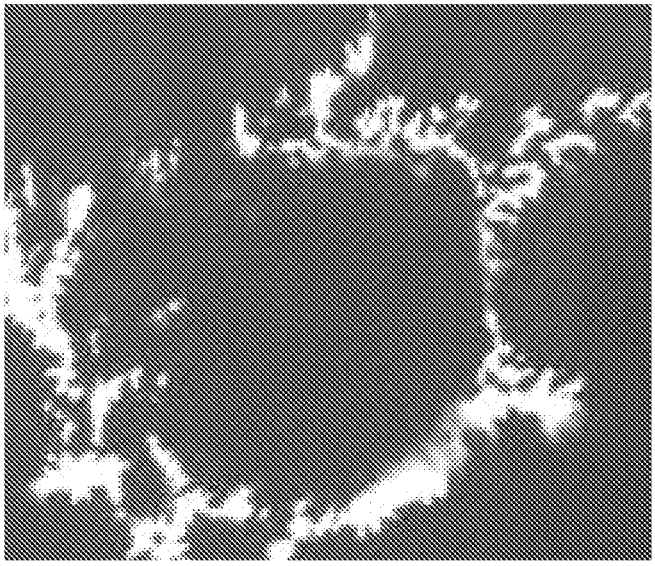
FIG. 10B is a photographic image of a magnetic structure unit captured by the microphotography system at 100× magnification according to an experimental example 2 of the disclosure.
Figure 11A:
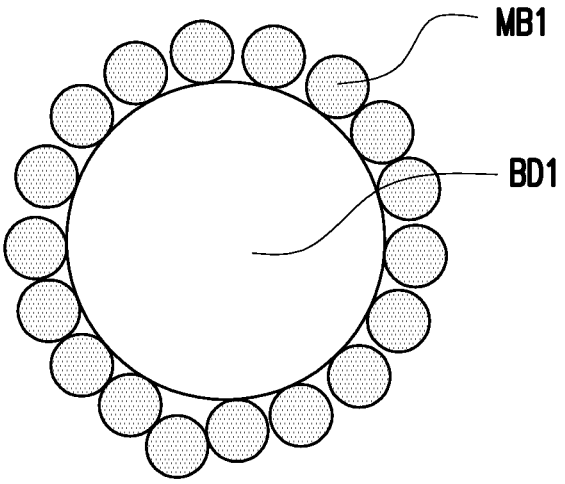
FIG. 11A is a schematic cross-sectional view illustrating the magnetic structure units in the experimental example 1 of FIG. 10A.
Figure 11B:
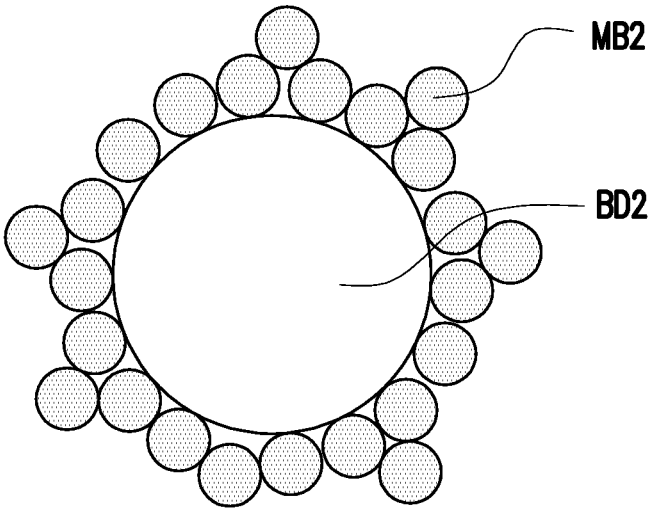
FIG. 11B is a schematic cross-sectional view illustrating the magnetic structure units in the experimental example 2 of FIG. 10B.
Figure 12A:
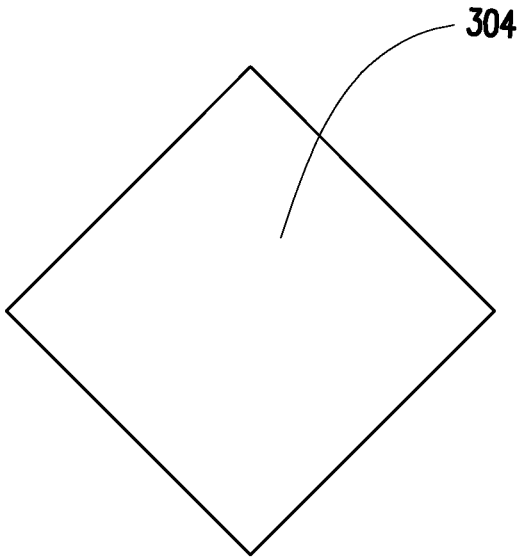
FIG. 12A and FIG. 12B are schematic cross-sectional views illustrating magnetic structure units according to an experimental example 3 and an experimental example 4 of the disclosure, respectively.
Figure 12B:
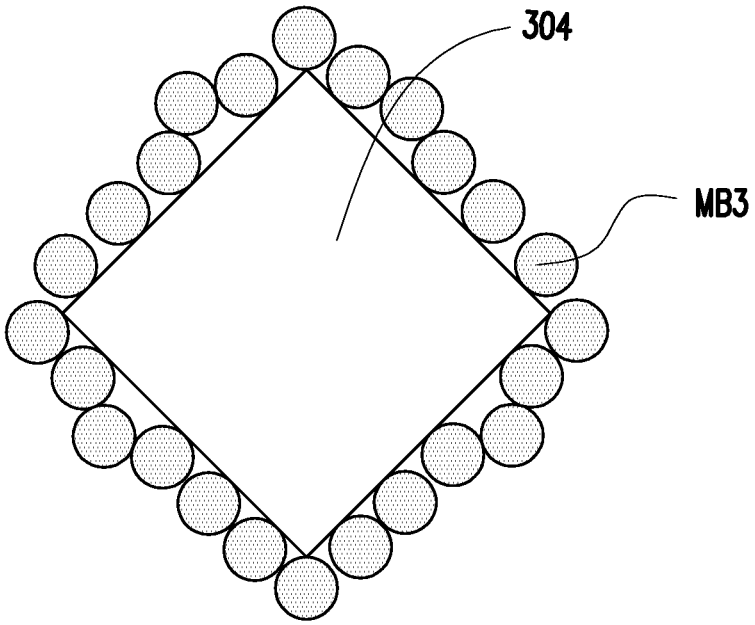

In the following, the separation effects of the magnetic separators of the aforementioned embodiments are explained with experimental examples. FIG. 10A is a photographic image of a magnetic structure unit captured by a microphotography system at 100× magnification according to an experimental example 1 of the disclosure. FIG. 10B is a photographic image of a magnetic structure unit captured by the microphotography system at 100× magnification according to an experimental example 2 of the disclosure. FIG. 11A is a schematic cross-sectional view illustrating the magnetic structure units in the experimental example 1 of FIG. 10A. FIG. 11B is a schematic cross-sectional view illustrating the magnetic structure units in the experimental example 2 of FIG. 10B. FIG. 12A and FIG. 12B are schematic cross-sectional views illustrating magnetic structure units according to an experimental example 3 and an experimental example 4 of the disclosure, respectively.

COMPARATIVE EXAMPLE 1, EXPERIMENTAL EXAMPLE 1 AND EXPERIMENTAL EXAMPLE 2

Palisade Magnetic Structure and Magnetic Structure Units

The palisade magnetic structures of the separators of the comparative example 1, the experimental example 1 and the experimental example 2 are similar to the palisade magnetic structure 202 of FIG. 8, and all adopt the magnetic bead structure units as the magnetic structure units. Differences among the comparative example 1, the experimental example 1 and the experimental example 2 are specified as follows. The magnetic bead structure units of the comparative example 1 adopt magnetic beads with a diameter of 300 μm but without protrusions. The magnetic structure units of the experimental example 1 (FIG. 10A and FIG. 11A) and the magnetic structure units of the experimental example 2 (FIG. 10B and FIG. 11B) use the surface of the 300 μm magnetic beads to absorb iron particles via magnetic field alignment to serve as the protrusions, and then are formed by performing to coat on the magnetic structure units using a polymer material, such as polylactic acid (PLA), poly(lactic-co-glycolic acid) (PLGA) or so forth. The magnetic beads of the comparative example 1, the experimental example 1 and the experimental example 2 adopt iron beads, and the magnetic structure units of the experimental example 1 and the experimental example 2 can adopt iron particles with a diameter from 5 nm to 10 μm as the protrusion. In the experimental example 1 and the experimental example 2, the diameter of the iron particles being adopted is 1 μm.

Referring to FIG. 11A and FIG. 11B, the magnetic structure units of the experimental example 1 (FIG. 11A) include magnetic beads BD1 and iron particles MB1. The iron particles MB1 are disposed on the magnetic beads BD1. The magnetic structure units of the experimental example 2 (FIG. 11B) include magnetic beads BD2 and iron particles MB2. The iron particles MB2 are disposed on the magnetic beads BD2. As compared to the magnetic structure units of the experimental example 1 (FIG. 11A), each of the magnetic beads BD2 of the magnetic structure units of the experimental example 2 (FIG. 11B) has more iron particles MB2 thereon, which means having more protrusions.

Next, the magnetic bead structure units of the comparative example 1, the experimental example 1 and the experimental example 2 are respectively filled into the housings and are stacked into the densest stacked structures so as to form the palisade magnetic structures.

Sample Solution

A cell separation test is performed using a KG1a cell line (human hematopoietic stem cell line, expressing CD34 surface antigens). The KG1a cells are performed to bind to the microbeads of 10 nm to 100 nm conjugated with CD34 antibodies. Moreover, the number of cells in the sample solution is adjusted to $3\times10^7$ cell/ml.

Separation Test

The housings configured with the palisade magnetic structures of the comparative example 1, the experimental example 1 and the experimental example 2 are placed into a magnetic field in a manner as shown in the magnetic separator 100 of FIG. 1. Next, 1 ml of sample solution is injected from the input opening of the housing into the continuous fluid channel of the palisade magnetic structure and flows out from the output opening of the housing. Next, three times of rinsing are performed using phosphate buffer saline (PBS). Afterwards, the housings configured with the palisade magnetic structures of the comparative example 1, the experimental example 1 and the experimental example 2 are moved out of the magnetic field, and the microbeads bound to the KG1a cells are eluted by the washing solution (PBS).

Test Results

The numbers of the KG1a cells eluted by the washing solution in the comparative example 1, the experimental example 1 and the experimental example 2 are calculated. Through calculation, the number of cells being separated in the comparative example 1 is approximately 60% of the number of cells being originally injected; namely, the separation effect is approximately 60%. The number of cells being separated in the experimental example 1 is approximately 68% of the number of cells being originally injected; namely, the separation effect is approximately 68%. The number of cells being separated in the experimental example 2 is approximately 82% of the number of cells being originally injected; namely, the separation effect is approximately 82%. As such, it can be known that the separation effects of those having the magnetic structure units covered with the protrusions on the surfaces thereof (e.g., the experimental example 1 and the experimental example 2) are better than ones without protrusions (e.g., the comparative example 1). In which, the better separation effect is demonstrated by the experimental example 2 that has the magnetic structure units with more protrusions (FIG. 11B), and it indicates that increasing the number of protrusions on the surfaces of the magnetic structure units can surely enhance cell separation effect.

EXPERIMENTAL EXAMPLE 3 AND EXPERIMENTAL EXAMPLE 4

Palisade Magnetic Structure and Magnetic Structure Units

The palisade magnetic structures of the separators of the experimental example 3 and the experimental example 4 are similar to the palisade magnetic structure 102 of FIG. 2, and the palisade magnetic structures of the experimental example 3 and the experimental example 4 are formed by 3D printing. The palisade magnetic structures of the experimental example 3 and the experimental example 4 both use columnar magnetic structure units to serve as the magnetic structure units, in which a length of the columnar magnetic structure units is 3 cm, a cross-sectional shape thereof in the arrangement direction is a rectangle, and a side length of the rectangle is 0.8 mm. The experimental example 3 and the experimental example 4 use the corners of the rectangle to serve as the protrusions of the magnetic structure units, and the difference between the experimental example 3 and the experimental example 4 is that the magnetic structure units of the experimental example 4 further include iron particles, and the iron particles can be adhered onto the palisade magnetic structure via UV gel so as to serve as the additional protrusions. That is, the protrusions of the magnetic structure units of the experimental example 4 include the corners of the rectangle and the iron particles (FIG. 12). Moreover, the magnetic structure units of the experimental example 4 can adopt iron particles with a diameter of 5 nm to 10 μm to serve as the protrusions. In the experimental example 4, the diameter of the iron particles being adopted is 1 μm.

Referring to FIG. 12A and FIG. 12B, the magnetic structure units of the experimental example 3 and the experimental example 4 include columnar magnetic structure units 304, and the magnetic structure units of the experimental example 4 further include iron particles MB3. The iron particles MB3 are disposed on the columnar magnetic structure units 304.

Next, the palisade magnetic structures of the experimental example 3 and the experimental example 4 are respectively filled into the housings.

Sample Solution

A cell separation test is performed using a KG1a cell line (human hematopoietic stem cell line, expressing CD34 surface antigens). The KG1a cells are performed to bind to the microbeads of 10 nm to 100 nm conjugated with CD34 antibodies. Moreover, the number of cells in the sample solution is adjusted to $3\times10^7$ cell/ml.

Separation Test

The housings configured with the palisade magnetic structures of the experimental example 3 and the experimental example 4 are placed into a magnetic field in a manner as shown in the magnetic separator 100 of FIG. 1. Next, 1 ml of sample solution is injected from the input opening of the housing into the continuous fluid channel of the palisade magnetic structure and flows out from the output opening of the housing. Next, three times of rinsing are performed using phosphate buffer saline (PBS). Afterwards, the housings configured with the palisade magnetic structures of the experimental example 3 and the experimental example 4 are moved out of the magnetic field, and the microbeads bound to the KG1a cells are eluted by the washing solution (PBS).

Test Results

The numbers of the KG1a cells eluted by the washing solution in the experimental example 3 and the experimental example 4 are calculated. Through calculation, the number of cells being separated in the experimental example 3 is approximately 57.8% of the number of cells being originally injected; namely, the separation effect is approximately 57.8%. The number of cells being separated in the experimental example 4 is approximately 81% of the number of cells being originally injected; namely, the separation effect is approximately 81%. As such, it can be known that the more protrusions as demonstrated in the experimental example 4, the better separation effect is displayed by the experimental example 4 as compared with the separation effect of the experimental example 3.

In view of the aforementioned experimental examples, since the magnetic structure units of the comparative example 1 do not have the protrusions, the separation effect thereof is less favorable. Due to the magnetic structure units of both the experimental example 1 and the experimental example 2 have protrusions, the effect of magnetic permeability can be effectively increased and the magnetic field gradient can be enhanced. That is, the separation effects of the experimental example 1 and the experimental example 2 are both better than that of the comparative example 1. In which, the experimental example 2, as its the magnetic structure units have the more iron particles (protrusions) thereon, has the better effect on magnetic permeability and magnetic field gradient, thereby further enhancing the cell separation effect. Similarly, in the palisade magnetic structures formed by the 3D printing of the experimental example 3 and the experimental example 4, since the magnetic structure units of the experimental example 4 are disposed with additional protrusions, the effect of magnetic permeability and the magnetic field gradient can be enhanced, thereby providing better cell separation effect.

In summary, in the magnetic separators as mentioned in the above embodiments, since the magnetic structure has the protrusions facing towards each other between at least a portion of the adjacent two magnetic structure units, the magnetic field gradient can effectively be enhanced, thereby enabling the magnetic separators to perform the better separation effects.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A magnetic separator, comprising:

a palisade magnetic structure formed by arranging columnar magnetic structure units into a palisade shape to form at least one continuous fluid channel, wherein a longest length of the columnar magnetic structure units is extended in a longitudinal direction, a fluid flows in the fluid channel in a flowing direction, and the palisade magnetic structure is positioned in a magnetic field, and wherein the longitudinal direction, the flowing direction, and a magnetic field direction of the magnetic field are perpendicular to each other;

at least one protrusion disposed on each of the columnar magnetic structure units, wherein some imaginary extension lines formed by connecting facing ones of the protrusions of some adjacent two of the columnar magnetic structure units are parallel to the magnetic field direction of the magnetic field, wherein other imaginary extension lines are parallel to the flowing direction; and a plurality of iron particles disposed on a surface of the columnar magnetic structure units.

2. The magnetic separator as recited in claim 1, wherein a material of the columnar magnetic structure units comprises a magnetic material or a composition of the magnetic material and a polymer material.

3. The magnetic separator as recited in claim 2, wherein the magnetic material comprises a metal soft magnet, a soft magnetic ferrite or a combination thereof.

4. The magnetic separator as recited in claim 2, wherein the polymer material comprises polylactic acid, poly(lactic-co-glycolic acid), polyethylene glycol, or a combination thereof.

5. The magnetic separator as recited in claim 1, wherein the palisade magnetic structure further comprises at least one connecting member connecting two of the columnar magnetic structure units.

6. The magnetic separator as recited in claim 1, wherein a forming method of the palisade magnetic structure comprises three-dimensional printing or injection molding.

7. The magnetic separator as recited in claim 1, wherein the columnar magnetic structure units are periodically arranged or non-periodically arranged.

8. The magnetic separator as recited in claim 1, wherein a length of the palisade magnetic structure in the flowing direction is greater than or equal to a length of the palisade magnetic structure in the magnetic field direction.

9. The magnetic separator as recited in claim 8, wherein the at least one continuous fluid channel extends along the flowing direction.

10. The magnetic separator as recited in claim 1, wherein a cross-sectional shape of the columnar magnetic structure units across the longitudinal direction comprises a polygon or a shape constituted by a base shape of the columnar magnetic structure unit and a protruding shape of the at least one protrusion.

11. The magnetic separator as recited in claim 10, wherein the polygon comprises a rhombus, a triangle, a square, a hexagon, or an octagon.

12. The magnetic separator as recited in claim 10, wherein the base shape comprises a circle, a rhombus, a triangle, a square, a hexagon, or an octagon.

13. The magnetic separator as recited in claim 10, wherein, in the cross-sectional shape, the cross-sectional shape of the at least one protrusion is corresponded to a corner of the polygon, the protruding shape of the at least one protrusion protruding out of the base shape or a combination thereof.

14. The magnetic separator as recited in claim 1, further comprising a magnetic field supply device, wherein the palisade magnetic structure is located inside the magnetic field supply device, and the magnetic field direction is provided by the magnetic field supply device.

15. The magnetic separator as recited in claim 14, wherein the magnetic field supply device comprises a permanent magnet or an electromagnet.

16. The magnetic separator as recited in claim 1, further comprising a housing, wherein the housing has an input opening, an output opening and a separation chamber, the separation chamber is located between the input opening and the output opening, and the palisade magnetic structure is disposed in the separation chamber.

17. The magnetic separator as recited in claim 16, wherein a material of the housing comprises a non-magnetic material.

* * * * *